US005493273A

United States Patent [19]

Smurlo et al.

[11] Patent Number: 5,493,273

[45] Date of Patent: Feb. 20, 1996

[54] SYSTEM FOR DETECTING PERTURBATIONS IN AN ENVIRONMENT USING TEMPORAL SENSOR DATA

[75] Inventors: Richard P. Smurlo; Hobart R. Everett, Jr., both of San Diego, Calif.

[73] Assignee: The United States of America as represented by the Secretary of the Navy, Washington, D.C.

[21] Appl. No.: 127,934

[22] Filed: Sep. 28, 1993

[51] Int. Cl.[6] ..... G08B 13/00

[52] U.S. Cl. ..... 340/541; 340/522; 340/529; 340/552; 340/309.15

[58] Field of Search ..... 340/541, 552, 340/555, 556, 557, 527, 522, 521, 511, 505, 517, 529, 309.15, 550; 317/93, 94

[56] References Cited

U.S. PATENT DOCUMENTS

| | | | |
|---|---|---|---|
| 4,112,419 | 9/1978 | Kinoshita et al. | 387/94 |
| 4,121,192 | 10/1978 | Wilson | 340/566 |
| 4,287,579 | 9/1981 | Inoue et al. | 367/94 |
| 4,318,089 | 3/1982 | Frankel et al. | 340/555 |
| 4,342,987 | 8/1982 | Rossin | 340/555 |
| 4,364,030 | 12/1982 | Rossin | 340/555 |
| 4,401,976 | 8/1983 | Stadelmayr | 367/94 |
| 4,746,910 | 5/1988 | Pfister et al. | 340/522 |
| 4,811,308 | 3/1989 | Michel | 340/541 |
| 4,942,384 | 7/1990 | Yamauchi et al. | 340/541 |
| 5,202,661 | 4/1993 | Everett, Jr. et al. | 340/522 |

*Primary Examiner*—Brent A. Swarthout
*Assistant Examiner*—Benjamin C. Lee
*Attorney, Agent, or Firm*—Harvey Fendleman; Thomas Glenn Keough; Michael A. Kagan

[57] ABSTRACT

A system for detecting perturbations within an environment, comprises: one or more arrays of sensors for providing a series of sensor output signal sets comprising the substantially contemporaneous generation of sensor output signals by the sensors in response to monitoring a scene within a coverage zone of the sensor; and a data processor operably disposed for storing a series of data corresponding to the sensor output signal sets generated at intervals over a predetermined period of time, for transforming the series of data into a final composite perturbation score, and for generating a perturbation output signal when the final composite perturbation score exceeds a reference value. The system may also include an output device for generating a perturbation alarm signal in response to the output device receiving the perturbation output signal.

2 Claims, 15 Drawing Sheets

SYSTEM FOR DETECTING PERTURBATIONS IN AN ENVIRONMENT USING TEMPORAL SENSOR DATA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to the field of intrusion detection systems, and more particularly to a system that uses temporal, contemporaneously generated outputs of multiple sensors configured in one or more sensor arrays to detect perturbations in an environment.

U.S. Pat. No. 5,202,661 describes a system for detecting an intrusion within an environment. Such system employs sensors located at fixed locations within the environment and sensors deployed on mobile platforms which patrol throughout the environment. A computer provides instructions to the mobile platforms so that they may be directed to travel along predetermined routes and be rapidly deployed to any region in the environment where a fixed sensor detects a perturbation which may correspond to an intrusion. The computer also receives the outputs of the fixed and mobile sensors and then determines a sum of weighting factors associated with the outputs of both the fixed and mobile sensors. The weights assigned to the sensor outputs are "fused" so that the sum is uninfluenced by detection of any of the traveling mobile platforms by the fixed sensors. The sum is compared to a reference whereupon the computer provides an output signal to enable an alarm system if the sum exceeds a reference value. The sum of weighting factor is based on the outputs of the sensors which are generated at one particular instant in time. In other words, the process implemented in the computer described in the '661 system uses a "snapshot" of data to determine the sum of weighting factors. Thus, in such system, the sum of weighting factors is not based on the history of the sensor outputs. However, an historical analysis of the sensor outputs generated over some time interval could provide useful information. For example, the sensors may generate outputs over time which yield a series of sums of weighting factors each based on evaluations of contemporaneously generated data that are less than some predetermined threshold limit having a reasonable probability of corresponding to an intrusion within the environment, whereas the same data considered collectively over a finite period of time may reveal the likelihood of an intrusion. Therefore, there is a need for an intrusion detection system that uses sensor data generated over a period of time to increase the sensitivity of an intrusion detection system without a concomitant increase in nuisance alarms.

SUMMARY OF THE INVENTION

The present invention provides a system for detecting perturbations within an environment, comprises: one or more arrays of sensors for providing a series of sensor output signal sets comprising the substantially contemporaneous generation of sensor output signals by the sensors in response to monitoring a scene within a coverage zone of the sensor; and a data processor operably disposed for storing a series of data corresponding to the sensor output signal sets generated at intervals over a predetermined period of time, for transforming the series of data into a final composite perturbation score, and for generating a perturbation output signal when the final composite perturbation score exceeds a reference value. The system may also include an output device for generating a perturbation alarm signal in response to the output device receiving the perturbation output signal.

DESCRIPTION OF THE PREFERRED EMBODIMENT

The present invention provides a system for using temporal sensor data to determine perturbations in an environment. The system uses data generated contemporaneously by multiple sensors configured into one or more sensor arrays to determine a composite perturbation score ("CPS") which is compared to reference value. A composite perturbation score exceeding a specified threshold results in generation of a perturbation alert. By way of example, without intending to limit the types of sensors which may be employed in the system of the present invention, the sensor arrays may include acoustic sensors, passive infrared sensors, ultrasonic sonar sensors, and/or microwave detecting sensors, as taught in U.S. Pat. No. 5,202,661, incorporated herein by reference. The present invention may be employed to detect perturbations which may be attributable to physical intrusions or other changes in the background scene within the fields of view of the sensor arrays.

Figure 1:
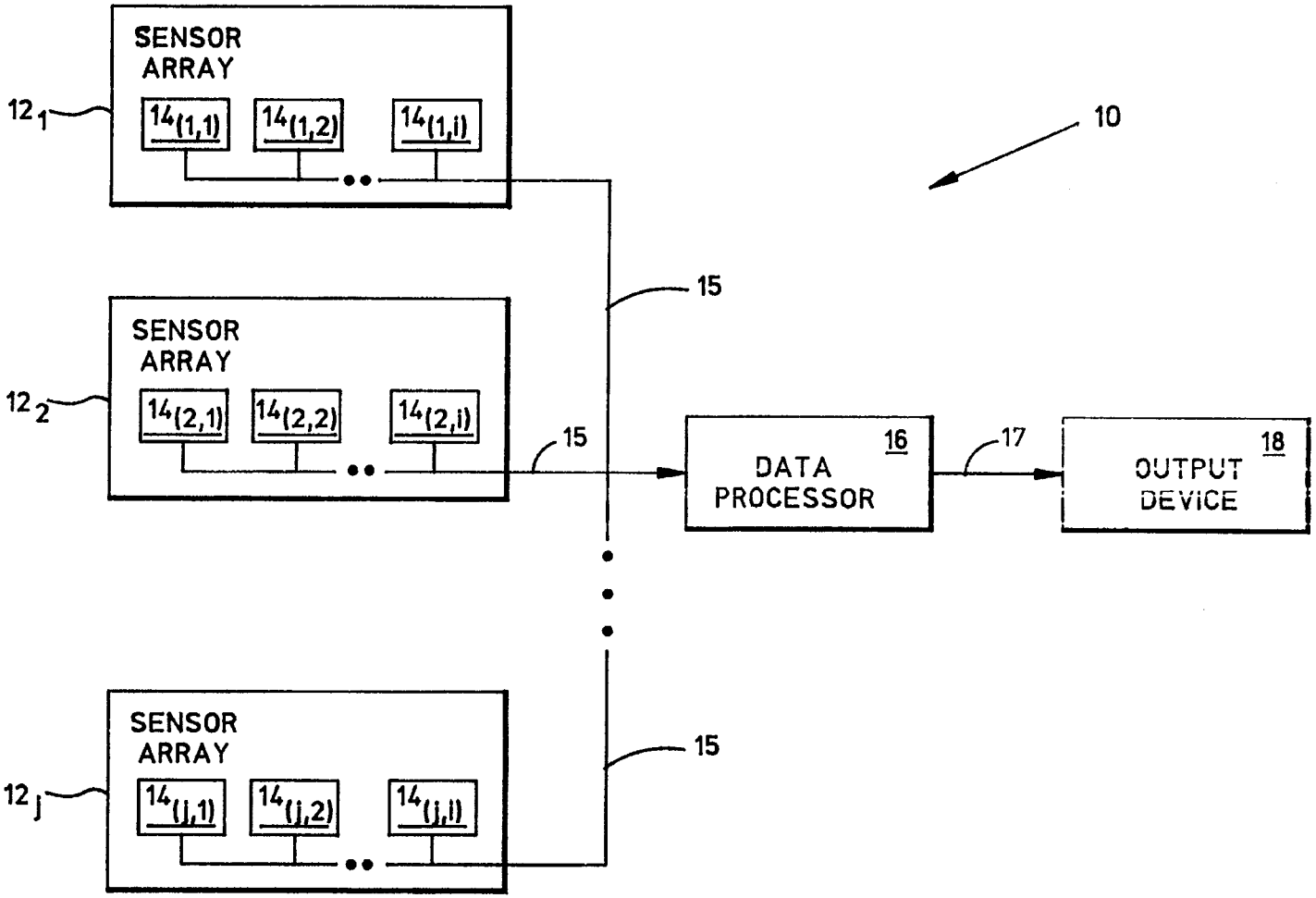
FIG. 1 is a block diagram of an intelligent security assessment system using temporal sensor data embodying various features of the present invention.

An overview of the hardware employed in system 10 of the present invention is described below with reference to FIG. 1 where there are shown one or more sensor arrays $\mathbf{12}_1$–$\mathbf{12}_j$, where j is a positive integer. Hereinafter it is to be understood that unless otherwise indicated, the sensor arrays $\mathbf{12}_1$–$\mathbf{12}_j$ are collectively referenced as sensor arrays 12. Each sensor array 12 includes multiple sensors $\mathbf{14}_i$ where i is a positive integer, and i may be a different value for each of the sensor arrays $\mathbf{12}_1$–$\mathbf{12}_j$. The outputs 15 of sensor arrays 12 are continuously provided to a data processor 16. However, only outputs 15 which are contemporaneously generated at specific intervals are stored by the data processor 16 to create a series of stored data sets. Data processor 16 uses the series of data sets to determine a composite perturbation score. If the composite perturbation score exceeds a specified threshold value, the data processor 16 generates a perturbation output signal which causes an output device 18, such as an audio alarm, video monitor, chart recorder, or the like, to generate a perturbation alert. The perturbation alert may be used to represent a reasonable possibility that an actual perturbation has occurred within the environment. A human operator monitoring the output device 18 may then appropriately respond. Moreover, in cases in which the composite perturbation score exceeds the threshold value, the data processor 16 generates a bearing signal to indicate the relative bearing to the detected perturbation.

The overall operation of the data processor 16, for determining the composite perturbation score and to generate a perturbation output signal when appropriate, is described with reference to the flow charts presented in FIGS. 2–14. Such process may be implemented using any suitable programming language, such as the Ada or "C" languages. By way of example, source code for implementing the processes represented in FIGS. 2–14 is provided in Appendix 1 to this specification and is written in Ada.

Figure 2:
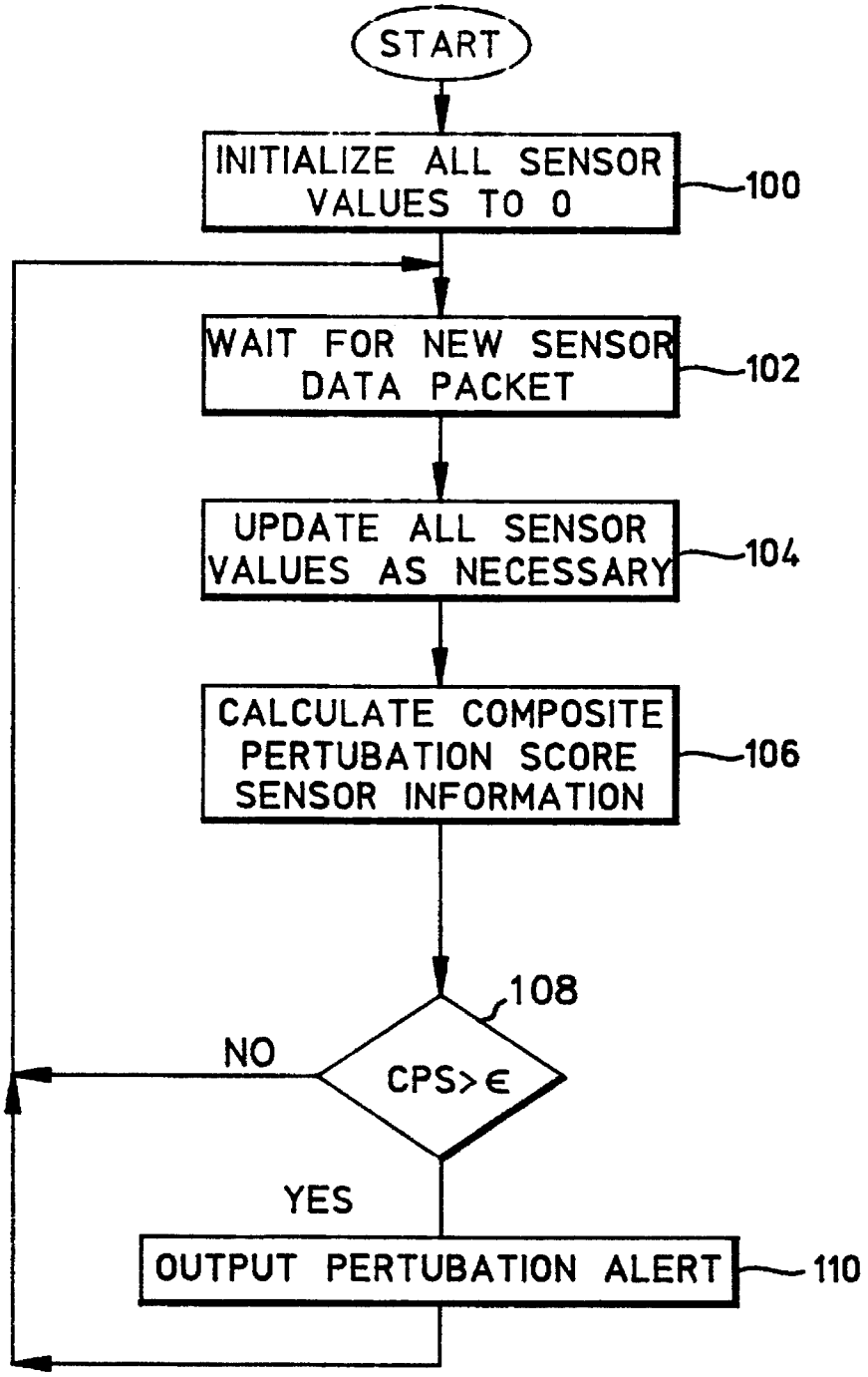
FIG. 2 is a high level flow chart illustrating the operation of the system shown in FIG. 1.
Figure 3:
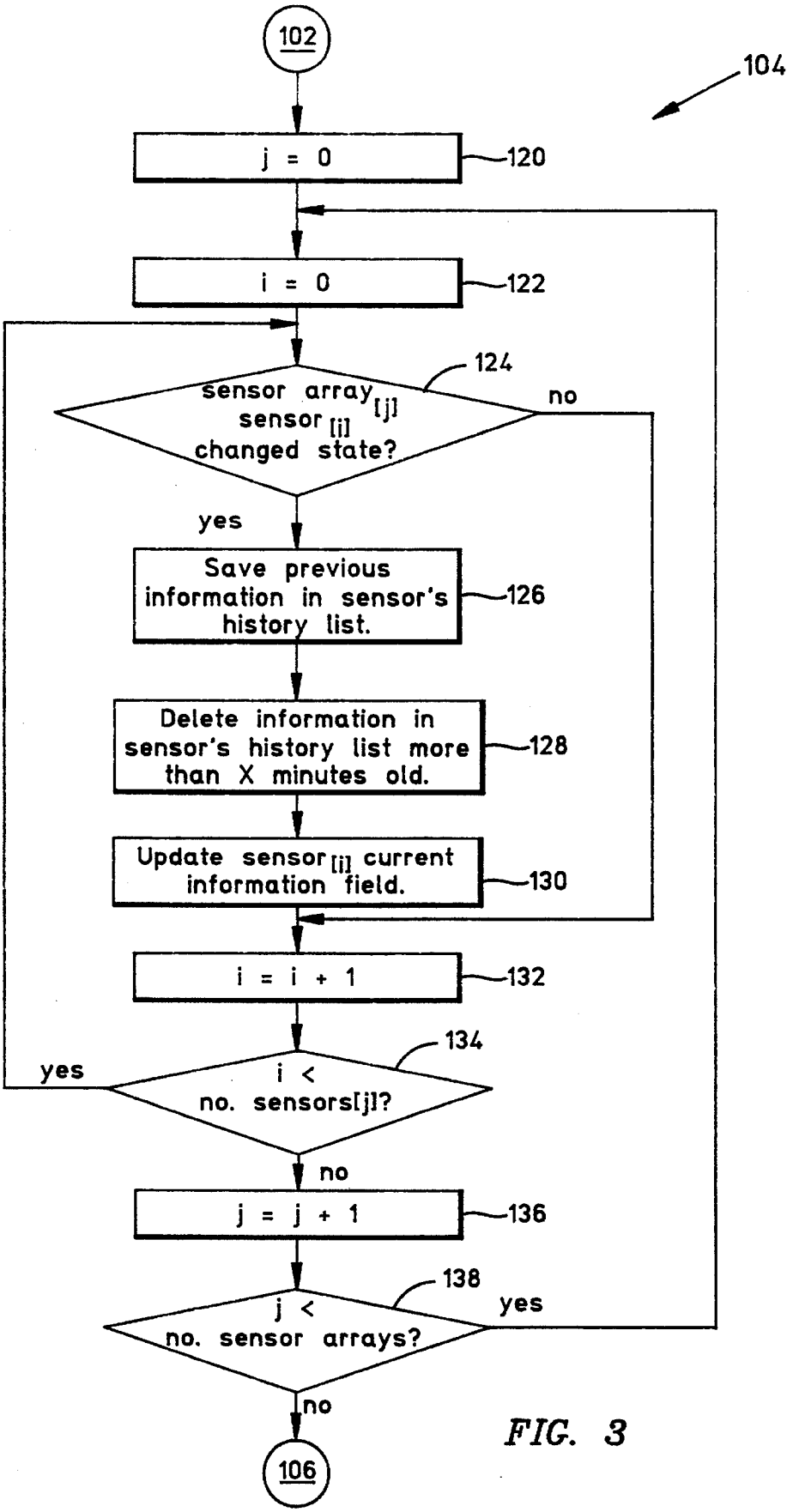
FIG. 3 is a more detailed flow chart of step 104 of FIG. 2.
Figure 15:
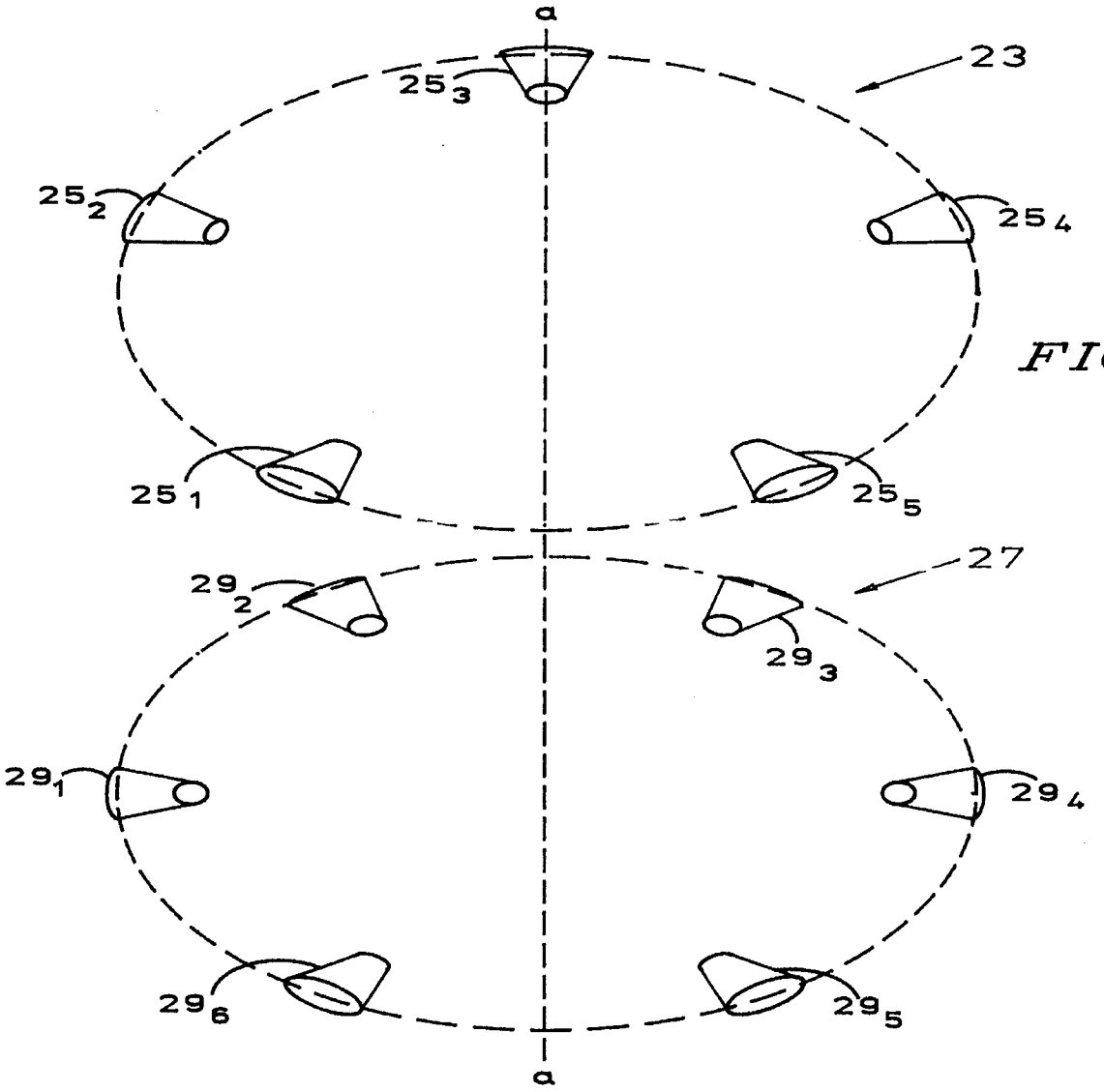
FIG. 15 represents two different types of coaxially aligned circular arrays.

FIG. 2 represents the main program perturbation assessment loop through which the data processor operates. On each passthrough the main program perturbation assessment loop, the state of each sensor 14, is monitored. If a sensor state has changed, its new state and the time are stored in a current information field of a blackboard data structure. The data that may have been previously stored in the current information field is placed in the front of a history list in the same data structure. In this way a detailed history of the state of each sensor 14 of each array 12 is maintained for a finite period of time, as for example, five minutes. Also, in the data structure is a baseline weight for each sensor 14 which determines how much each sensor contributes to the overall composite perturbation score. The baseline weighting values are taken from an array and are generally empirically determined based on experience with a particular type of sensor, i.e. passive infrared or acoustic, and the particular application in which such sensor type is used. After the new data has been read in to the data structure, a perturbation assessment function is called. Such function adjusts some or all of the sensor weights when purposeful motion is detected by the sensors 14 or when sensors of different types correlate with each other. Correlation of sensors means that sensors of different types, that is in different arrays, detect a perturbation in the same region of the environment at substantially the same time. By way of example, consider a system of the type shown in FIG. 15 that includes two sensor arrays: an array 23 of (5) infrared sensors $\mathbf{25}_i$, where i=1 to 5; and an array 27 of (6) acoustic sensors $\mathbf{29}_j$, where j=1 to 6. In this example, the sensors 25 and 29 are configured into two coaxially aligned circular arrays 23 and 27, respectively, arranged concentrically about the axis a-a, with the fields of view of the sensors 25 and 29 directed outwardly from the centers of the circles. Given that infrared sensor $\mathbf{25}_5$ and infrared sensor $\mathbf{29}_5$ generally cover the same region, if these two sensors detect a perturbation at substantially the same time, the outputs of such sensors may then be "correlated." Correlating the outputs of sensors means that the outputs of such sensors have enhanced significance whereupon higher weighting values will be assigned to these sensors than would be the case if one or none of these sensors detected a perturbation. The perturbation assessment function then calculates the composite perturbation score based on the adjusted weights. The methods for adjusting the weights corresponding to each sensor and then determining the composite perturbation score are discussed below.

The information stored in the history file is analyzed for signs of purposeful motion and the weights for sensors that indicated potential perturbations are adjusted accordingly, as explained in greater detail further herein, and stored as the updated current information. Then, the first active sensor of a given sensor array is identified. An active sensor is defined as one which changes state, indicating a detected perturbation. If a sensor to the right or left of the active sensor that detects a perturbation is also currently active, the weight corresponding to the active sensor is increased by a scalar factor $K_0$. For example, with reference to FIG. 15, if the active sensor is sensor $\mathbf{25}_5$ of sensor array 23, then the stored data representing the outputs of sensor $\mathbf{25}_4$ and $\mathbf{25}_1$ will be examined since sensor $\mathbf{25}_5$ is interposed between or "adjacent" to sensors $\mathbf{25}_4$ and $\mathbf{25}_1$. Data stored in the history file is then examined to determine if adjacent sensors of the same sensor array on either side of the active sensor had previously been active within some previously specified period of time. If such activity is present, the weight corresponding to each active sensor is increased by an increment equal to its initial weight multiplied by a scalar, $S_1$. In the event an adjacent sensor is found to have been active, the history file is again examined to see if the next sensor in the array also had previously detected motion. If previous motion is again indicated, the weight of the active sensor is further increased by a second increment equal to its initial weight times sum scalar $S_2$. This process is then repeated for all other active sensors in the sensor array after which the remaining sensor arrays are similarly examined.

In this fashion if the temporal history of lateral motion across the field of view of two or more adjacent sensors of a sensor array indicates that two or more sensors are activated in a distinct sequence, the resultant signature is classified as purposeful motion whereupon the weights for such active sensors are significantly increased.

The next step in determining the composite perturbation score involves converting the individual sensor weights to zone weights for each sensor array. This technique is referred to as cross-correlation or angular sensor fusion. The technique of angular sensor fusion is implemented by first determining the probability that an actual perturbation was detected in the field of view common to the active sensors of each sensor array. For example, if an active sensor lies on the boundary of two zones there is a 50% probability that the perturbation is in either zone. A calculated probability is multiplied by the weight associated with the sensor, determined as described above, and the values are summed for each sensor covering the zone in which the perturbation was detected. The zone weights for each sensor group are then checked for correlation and increased accordingly where appropriate, thus minimizing the occurrence of nuisance alarms. Correlating the zone weights involves first converting the individual sensor weights for each sensor array into a predetermined number of zones, as for example 24 zones of 15 degrees of arc. Then the zones of each sensor array are compared with the corresponding zones of other sensor arrays. If two corresponding zones have non-zero weights, their zone weights are increased as follows:

$$\text{New zone weight } (\text{array}_{i,j}) = \text{Old zone weight } (\text{array}_{i,j}) + K1\,[(\text{Intermed. Zone Weight } (\text{array}_{i,j})) + (\text{Intermediate Zone Weight } (\text{array}_{k,j}))],$$

where i and k refer to particular arrays 12, $i \neq k$, and j represents a specific sensor zone of one particular sensor array 12.

It is to be noted that when zone weights are initially calculated for each sensor array, the zone weights are stored in an "intermediate zone weight" array. The intermediate zone weights are used to determine the amount to be added to a zone weight when cross-correlation in performed in the outputs of two or more sensors in a corresponding number of sensor arrays. By way of example, if correlating zones of sensor $\text{array}_1$, sensor $\text{array}_2$, and sensor $\text{array}_3$, have initial (i.e., "intermediate") values of "A", "B", and "C", respectively, then the zone weights associated with each of these sensor arrays may be increased as follows:

1) New zone $\text{weight}_{(array\ 1,i)}$=A+K1(A+B)+K1(A+C)

2) New zone $\text{weight}_{(array\ 2,j)}$=B+K1(B+A)+K1(B+C)

and

3) New zone $\text{weight}_{(array\ 3,j)}$=C+K1(C+A)+K1(C+B), where the indix j refers to a zone covered by an array 12, and the references 1, 2, and 3 refer to particular arrays. Thus, it may be appreciated that the increase in weighting is proportional to the confidence factor of the confirming sensor. This process is then repeated for all zones covered by each sensor array.

Once the various weight contributions have been generated for the individual sensors of each sensor array, a perturbation calculation function is implemented in the data processor 16 which sums the individual sensor group zone weights to generate a single composite perturbation score for each zone. The maximum composite perturbation sum of the individual zones is then used as the current composite perturbation score. To smooth out the composite perturbation score which may be presented by the output device 18, the current composite perturbation score is compared to the composite perturbation scores determined within a predetermined period as, for example, the last four seconds. The maximum of such composite perturbation scores becomes the new composite perturbation score.

The composite perturbation score is then further adjusted by a persistence factor ("PF") which provides an additional predefined contribution to the composite perturbation score. Determination of the persistence factor is described in greater detail further herein. The persistence factor is indicative of and proportional to the magnitude and duration of prior detected activity within the field of view of the sensor arrays. The persistence factor serves to increase system sensitivity in cases where some activity was previously detected although such activity was in itself insufficient to generate an alarm condition.

In the preferred embodiment, the persistence factor is upwardly bounded by an appropriate finite number which may be determined empirically to suit the requirements of a particular application. The final composite perturbation score then equals the initial composite perturbation score plus the persistence factor.

The final adjusted composite perturbation score is then compared to a predetermined threshold value. If the composite perturbation score exceeds the threshold, the data processor 16 generates a signal which is provided to the output device 18, whereupon the output device provides an output signal or alert of a perturbation which may be discerned by a human operator monitoring the output device. Data processor 16 stores all of the data generated by the arrays 12 at one particular instant in time to create a first stored data set. Then at step 100, all sensor data comprising the first stored data set are each initialized to have a value of 0. Then data processor 16 stores a second set of sensor data contemporaneously generated a predetermined interval of time after generation of the data comprising the first stored data set. Next, at step 104, the process or program updates all the stored sensor data. Updating sensor data refers to moving data previously stored in the current information field into the, front of a history list and then storing new data just received at time (t) in the current information field. Similarly, all data previously stored in the current information field and moved to the front of the history list is moved to a data field representing data generated one additional increment further back in time. The oldest data stored in the history list is then overwritten with data stored in the next to last field of the history list. At step 106, a subroutine is called which calculates a composite perturbation score based on the stored sets of successively generated groups of data. The program proceeds to step 108 where a comparison is made between the composite perturbation score and a predetermined threshold value, $\epsilon$. If the composite perturbation score is greater than $\epsilon$, the process proceeds to step 110 whereupon the data processor 16 generates an output signal 17 which causes output device 18 to generate an output alarm. If, on the other hand, the composite perturbation score is not greater than the predetermined threshold value ($CPS \leqq \epsilon$), the program loops back to step 102. The sensor values are updated at step 104 in accordance with the steps illustrated in the flow chart presented in FIG. 3. At steps 120 and 122 indices j and i are initialized so that they each have a value of 0, where i and j are positive integers. The index i represents a particular sensor and j represents a specific array $\mathbf{12}_j$ of sensor arrays 12. The program proceeds to step 124 where determination is made as to whether sensor $\mathbf{14}_i$ of sensor array $\mathbf{12}_j$ had changed state. If that determination is yes, the program proceeds to step 126 which saves the previous set of stored data corresponding to the output of sensor $\mathbf{14}_i$ of sensor array $\mathbf{12}_j$. At step 128, data representing the output of sensor $\mathbf{14}_i$ of sensor array $\mathbf{12}_j$ corresponding to data which is older than a predetermined interval of time are deleted. Then at step 130 data processor 16 stores the output of sensor $\mathbf{14}_i$ of sensor array $\mathbf{12}_j$ in the current information field of sensor $\mathbf{14}_i$ of sensor array $\mathbf{12}_j$. If, however, the determination at step 124 is no, that is, sensor $\mathbf{14}_i$ of sensor array $\mathbf{12}_j$ did not change state, the program proceeds to step 132 where the index i is incremented. The program continues as step 134 where a determination is made as to whether or not the index i is less than the number of sensors $\mathbf{14}_i$ and sensor array $\mathbf{12}_j$. If the determination at step 134 is yes, the program returns to step 124 so that data generated by other sensors in sensor array $\mathbf{12}_j$ is considered. If, however, the determination at step 134 is no, the program continues to step 136 where j is incremented so that data generated by the next sensor array $\mathbf{12}_{j+1}$ may be considered. Then a determination is made at step 138 as to whether or not j is less than the number of sensor arrays $\mathbf{12}_j$. If the determination at step 138 is yes, the programming turns to step 122, where "yes' means that the outputs of additional sensor arrays 12 are to be evaluated. If, however, the determination at step 138 is no, the program implemented in the data processor 16 continues on to step 106 depicted in FIG. 2.

The steps necessary to calculate the composite perturbation score represented by step 106 of FIG. 2 are shown in greater detail in FIG. 4, described below. Referring to step 150 of FIG. 4, all sensor weights assigned to the data representing the stored outputs of each sensor 14 of each sensor array 12 are reset to an appropriate predetermined value which may be different for each different type of sensor 14. For example, the weights correlated to the data generated by the sensors 14 of sensor array $\mathbf{12}_2$ may be different from the weights assigned to the sensors 14 of the sensor array $\mathbf{12}_3$. The weights are empirically determined based on the reliability of a particular type of sensor to discern actual perturbations as opposed to false indications or nuisance trips. For example, the video motion detector and passive infrared sensors of the type described in U.S. Pat. No. 5,202,661, incorporated herein by reference, tend to be very reliable in discerning actual perturbations and rarely cause false indications of anomalies. However, the microwave sensors and sonar sensors described in U.S. Pat. No. 5,202,661 generate beams that characteristically may bounce off walls or other objects. These latter sensors may detect a perturbation in front of themselves when the actual location of the perturbation may being a different location, or not even have existed at all. Therefore, by way of example, the relative weight associated with the output of the video motion detector or passive infrared sensors may be 36, whereas the relative weight associated with the microwave or sonar sensors may be 12. Such relative weights indicate that the higher level of confidence in the outputs of the video motion detector and passive infrared detectors as opposed to the lower level of confidence in the outputs of the microwave and sonar sensors.

Next, at step 152 all sensor data stored in the data processor 16 corresponding to sensor data older than a predetermined interval of time, X, which may for example be five minutes, is deleted from the information fields or history lists for each sensor 14 of each sensor array 12. At step 154 the weights assigned to data associated with each sensor 14 of each sensor array 12 are increased if purposeful motion (described in greater detail further herein) is detected by any of the sensors 14 of each sensor array $\mathbf{12}_j$ of the sensor arrays 12. At step 156 the individual sensor zone weights are calculated, as described in greater detail further herein. Generally, however, each sensor array may have a different number of sensors each having a field of view in which detection of perturbations is desired. Regardless of how many sensors comprise a sensor array, the sensors of each array are mapped to a predetermined number of sensor zones. Each sensor zone has an associated weight, referred to as a "sensor zone weight$_i$, where i represents a particular sensor zone of a set of sensor zones covered by the sensor arrays. The sensor zone weight$_i$ is calculated by summing a fraction of each individual sensor weight of the sensors of each sensor array that cover or partially cover a particular portion. For example, if an individual sensor of one sensor array lies on the boundary of two sensor zones, then 50 per cent of the sensor weight for that sensor is added to each of the two zone weights corresponding to such two sensor zones.

Next, at step 158 the weight associated with each sensor zone is increased if another aligned sensor zone detects motion. An aligned sensor zone refers to those sensors of different sensor arrays 12 which are positioned to detect perturbations from the same region. Continuing at step 160, a composite perturbation score and bearing to a perturbation detected by some or all of the sensors 14 of any of the sensor arrays 12 are determined. Next, referring back to FIG. 2, a determination is made as to whether or not a CPS>$\epsilon$. If the determination at step 108 is no (CPS$\leqq\epsilon$), the operation of data processor 16 continues at step 102. If, however, CPS>$\epsilon$, data processor 16 generates the output signal 17 which is provided to the output device 18 whereupon the output device generates an output signal which is discernable by a human, as for example, an audio or video signal. Then, the process 2 returns to step 102.

Figure 4:
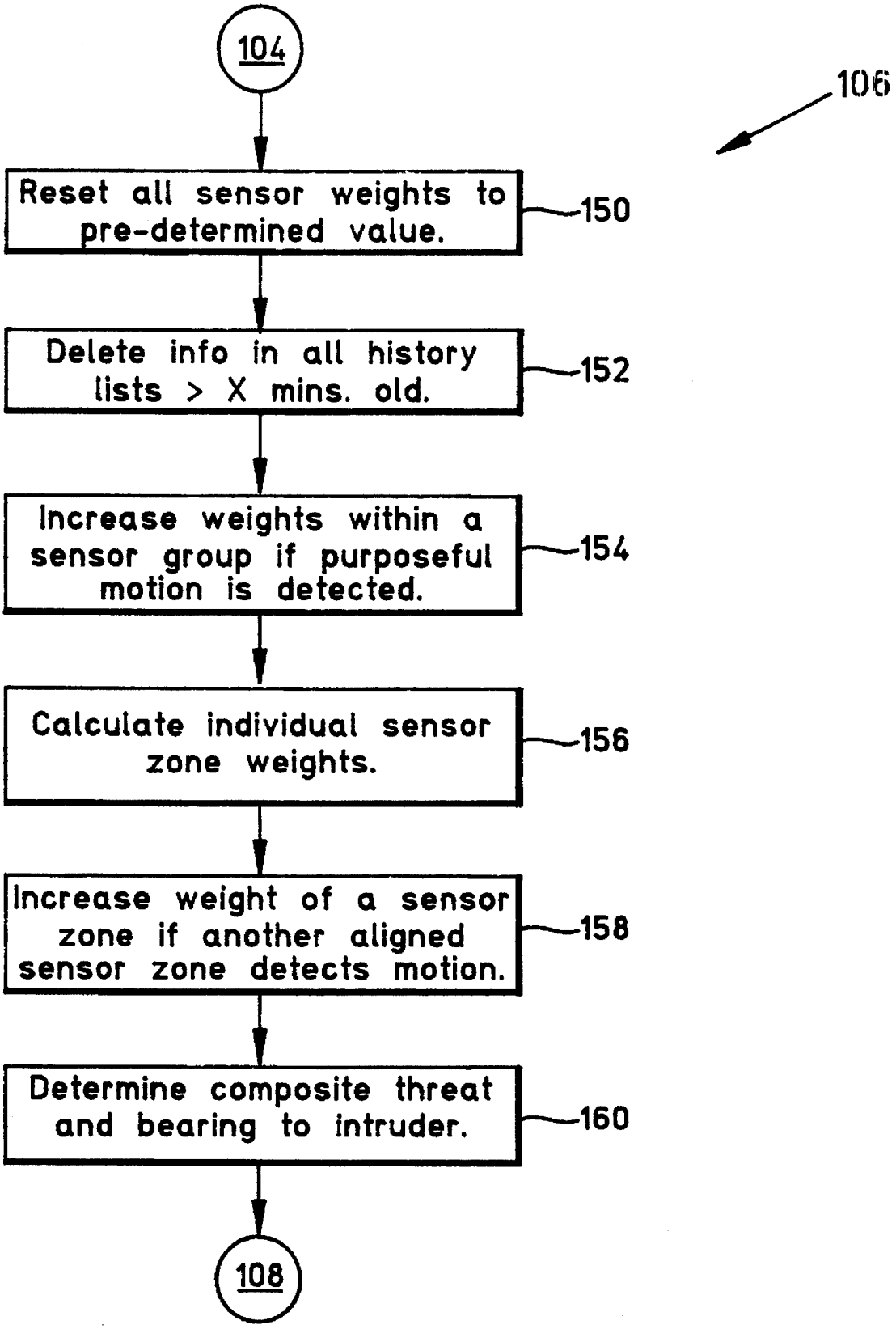
FIG. 4 shows additional details of step 106 of FIG. 2.
Figure 5:
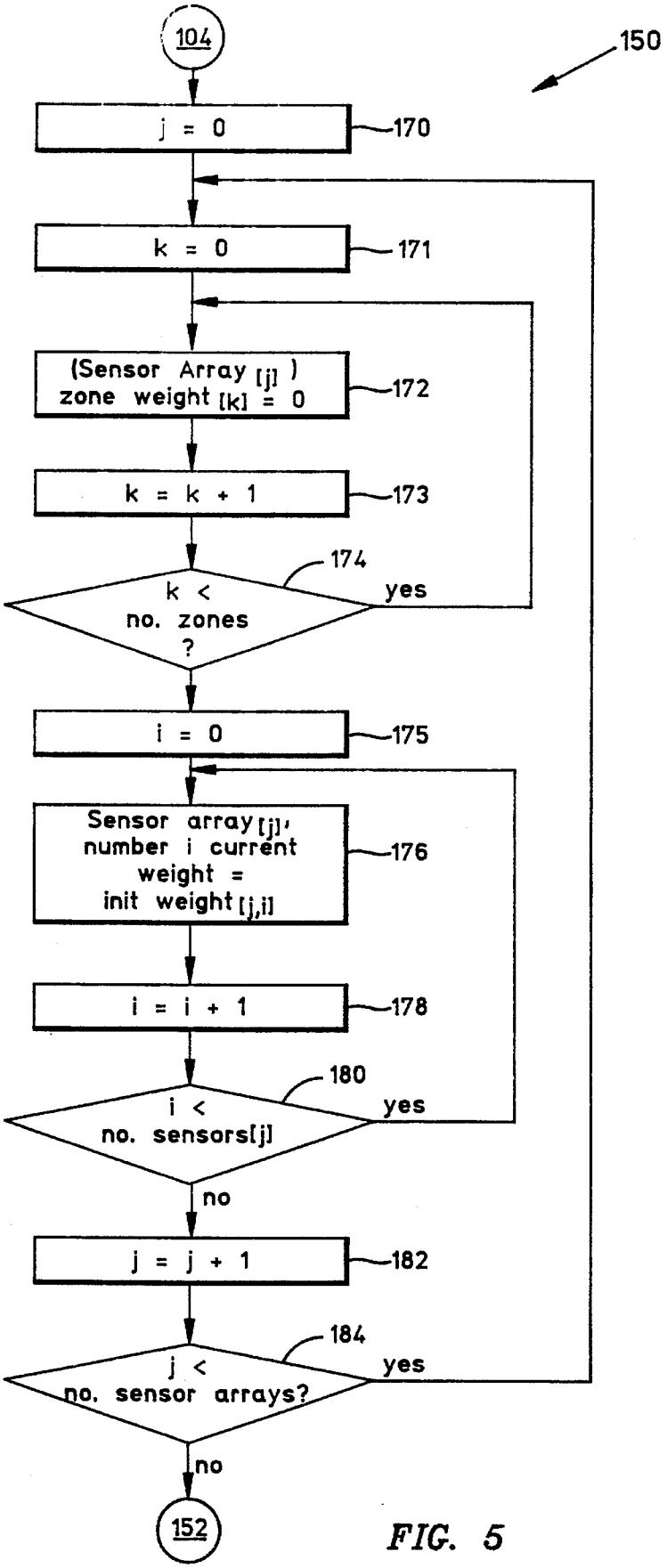
FIG. 5 is a flow chart showing more detailed steps of block 150 of FIG. 4.

Referring now to FIG. 5, there is shown in greater detail the steps involved in resetting all the sensor data weights to predetermined values as set forth at step 150 of FIG. 4. At steps 170 and 171, index counters j and k, are initialized, respectively, so as to have values to 0. In FIG. 5, the index i represents a particular sensor $\mathbf{14}_i$ of a sensor array$_j$ and the index k represents a particular sensor zone. Next, at step 172, the zone weight$_k$ of a particular sensor array$_j$ is initialized to have a value of zero. Then k is incremented at step 173. At step 174, a determination is made as to whether or not the value of the index k is less than the number of sensor zones. If the result of step 174 is yes, the program returns to step 172, otherwise the index i is initialized to be zero at step 175. Next, at step 176, the current sensor weight (for sensor$_i$ of sensor array$_j$) is re-initialized to its initial value, initial zone weight$_{(j,i)}$, where the indices j and i represent the particular sensor array$_j$ and sensor$_i$, respectively. The initial value of the current sensor weight may then be incremented if, for example, purposeful motion is detected. Since the initial value may change, it must be re-initialized each time a new set of sensor data is received. Then at step 178, index i is incremented. Continuing to step 180, a comparison is made between i and the number of sensors 14 in a particular sensor array $\mathbf{12}_j$. If i is less than the number of sensors 14 in the sensor array $\mathbf{12}_j$, the program returns to step 176, otherwise, j is incremented at step 182. Next, a determination is made at step 184 as to whether j is less than the number of sensor arrays $\mathbf{12}_j$. If the result of step 184 is yes, the program returns back to step 171. If j is not less than the number of sensor arrays $\mathbf{12}_j$, the program returns to step 152 shown in FIG. 4.

Figure 6:
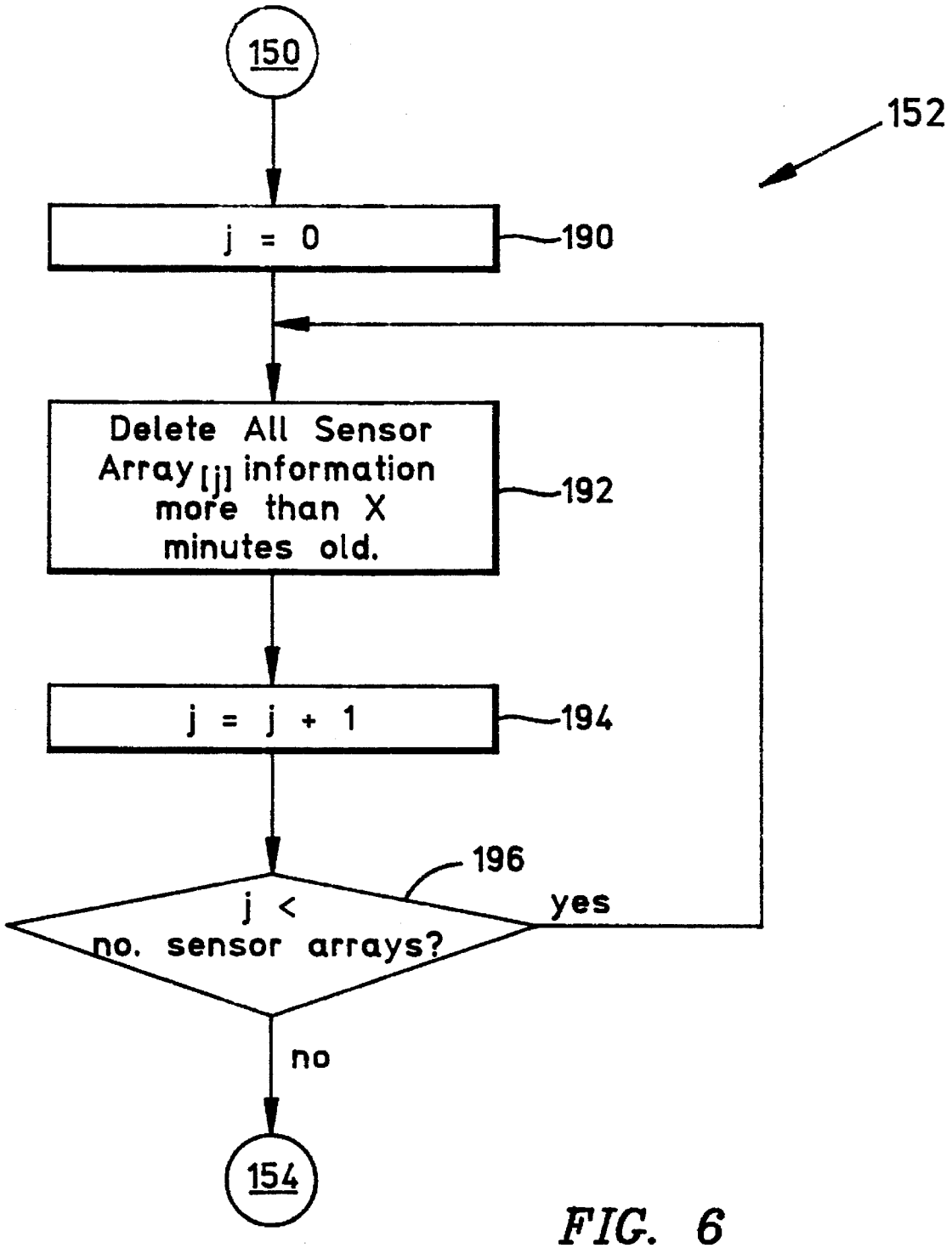
FIG. 6 is a flow chart illustrating more detailed steps of block 152 of FIG. 4.

At step 152 all stored sensor data for each sensor array 12 older than a predetermined amount of time are deleted, as described with reference to the flow chart represented in FIG. 6. Referring now to FIG. 6 at step 190, the index j is set to zero, where j represents a specific sensor array $\mathbf{12}_j$. Next, at step 192 all sensor data pertaining to sensor array $\mathbf{12}_j$ which is older than a predetermined time interval, X, is deleted. At step 194 the index j is incremented and at step 196 the index j is compared with the number of sensor arrays $\mathbf{12}_j$. If j is less than the number of sensor arrays 12, the program returns to step 192. If, however, j is not less than the number of sensor arrays, the program continues to step 154 shown in FIG. 4.

Additional details regarding the implementation of step 154 presented in FIG. 4 are described below with reference to FIG. 7. The indices j and i are initialized to have values of 0 at step 200 and 202, respectively, where j represents a particular sensor array $\mathbf{12}_j$ and i represents a particular sensor $\mathbf{14}_i$ in sensor array $\mathbf{12}_j$. Continuing at step 204 a determination is made as to whether sensor $\mathbf{14}_i$ of sensor array $\mathbf{12}_j$ is active. If the result of step 204 is yes, then a determination is made as to whether sensor $\mathbf{14}_{i+1}$ was active. An active sensor refers to a sensor that is detecting a perturbation. If two adjacent sensors are contemporaneously active, then the weights corresponding to each such sensor is increased since both sensors are probably detecting to same perturbation. Thus, adjacent contemporaneously active sensors tend to corroborate one another. If the result of step 206 is yes, the weight associated with sensor $14_i$ is increased by a scalar factor K0. The process then continues to step 208 where a determination is made as to whether sensor $14_{i-1}$ was active. If the result of step 208 is yes, then at step 212 the weight associated with sensor $14_{i-1}$ increases by the factor K0. The program then continues to step 214 where the outputs of the sensors $14_{i+1}$ and $14_{i-1}$ are evaluated for left-to-right purposeful motion. Next, proceeding to step 216, the program checks the stored data corresponding to the contemporaneously generated outputs of sensors $14_{i+1}$ and $14_{i-1}$ for right-to-left purposeful motion. The program proceeds to step 218 where the index i is incremented. If the result of step 204 is that a sensor $14_i$ was not active, then the program proceeds to step 218. Next, at step 220 a determination is made as to whether i is less than the number of sensors 14 in a particular sensor array $12_j$. If the result of step 220 is yes, the process returns to step 204. If, however, the result of step 220 is no, then at step 222, index j is incremented and a comparison is made at step 224 to determine whether the index j is less than the number of sensor arrays $12_j$. If the result of step 224 is yes, the process returns to 202. Otherwise, the process continues to step 156, shown in FIG. 4.

Figure 7:
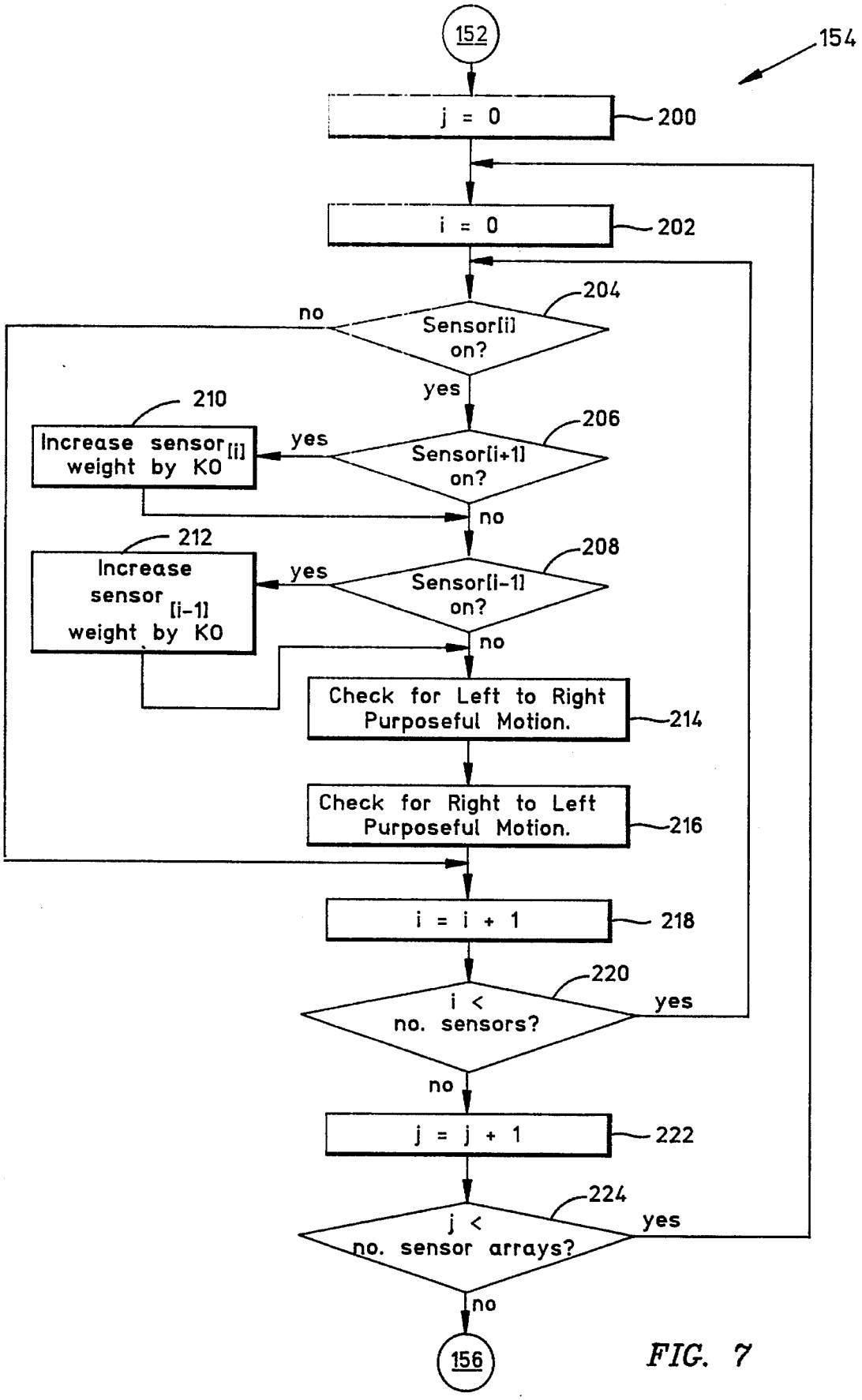
FIG. 7 is a flow chart showing more detailed steps of block 154 of FIG. 4.
Figure 8:
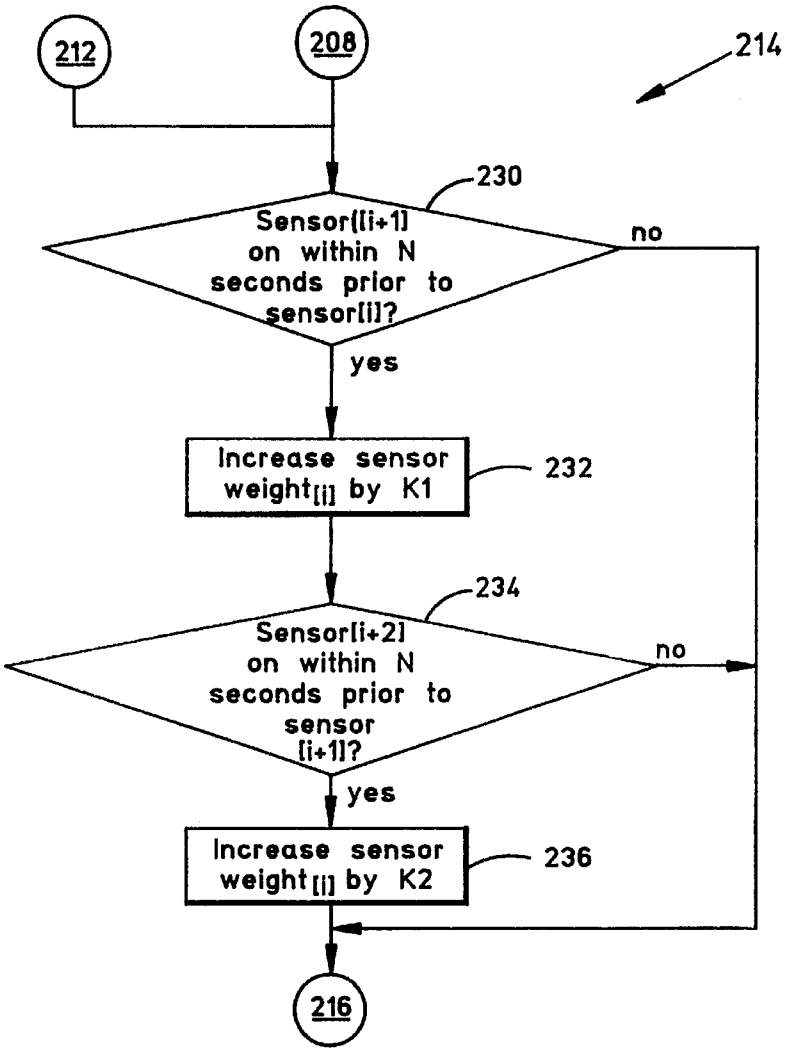
FIG. 8 is a flow chart illustrating more detailed steps of block 214 of FIG. 7.

Additional details regarding step 214 of FIG. 7 for evaluating stored sensor data for left-to-right purposeful motion are provided in FIG. 8, where at step 230 a determination is made as to whether sensor $14_{[i+1]}$ was active within n seconds prior to activation of sensor $14_i$ of sensor array $12_j$. If the result of step 230 is yes, then the weight assigned to the data generated by sensor $14_i$ is increased by a scalar factor of K1. Next, a determination is made as to whether sensor $14_{[i+2]}$ was active within n seconds prior to activation of sensor $14_{[i+1]}$. If the result of step 234 is yes, the data associated with the output of sensor $14_i$ of sensor array $12_j$ is increased by a factor of K2. The program then returns to step 216 described above with reference to FIG. 7. If the results of either of steps 230 or 234 are no, the program returns directly to step 216 described above with reference to FIG. 7.

Figure 9:
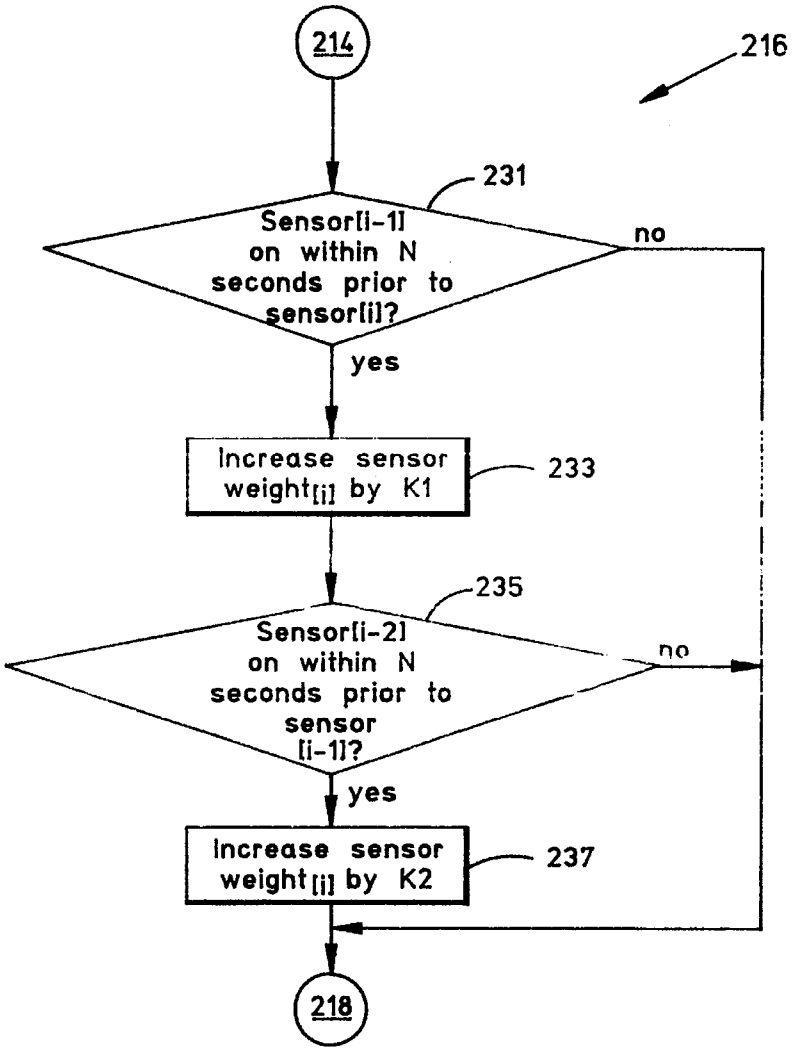
FIG. 9 is a flow chart illustrating more detailed steps of block 216 of FIG. 7.

Further details pertaining to step 216 of FIG. 7 for evaluating the stored data for right-to-left purposeful motion are provided below with reference to FIG. 9. At step 231 a determination is made as to whether or not sensor $14_{[i-]}$ of sensor array $12_i$ is active within n seconds prior to activation of sensor $14_i$. If the result of step 231 is yes, then at step 233, the weight value assigned to the data representing the output of sensor $14_i$ is increased by a factor of K1. Next, a determination is made at step 235 as to whether or not sensor $14_{[i-2]}$ was active within n seconds prior to activation of sensor $14_{[i-1]}$. If the result of step 235 is yes, then at step 237, the weight assigned to the data associated with the output of sensor $14_i$ is increased by a factor of K2. Then the program returns to step 218 described above with reference to FIG. 7. If the result of either of steps 231 or 235 are no, the program returns to step 218.

The calculation of the individual zone weights represented by step 156 of FIG. 4 is described in greater detail as follows: After the individual sensor weights for a given sensor array have been adjusted for purposeful motion, the sensor weights are mapped into zones about the region covered by the sensors. By way of example, and for convenience, the region may be subdivided into equally sized regions. Subdividing the region which is to be subject to surveillance is done separately for each one of the sensors of every sensor array so that an algorithm implemented in the data processor 16 can compare the weights assigned to each zone by the different sensor arrays.

Figure 16:
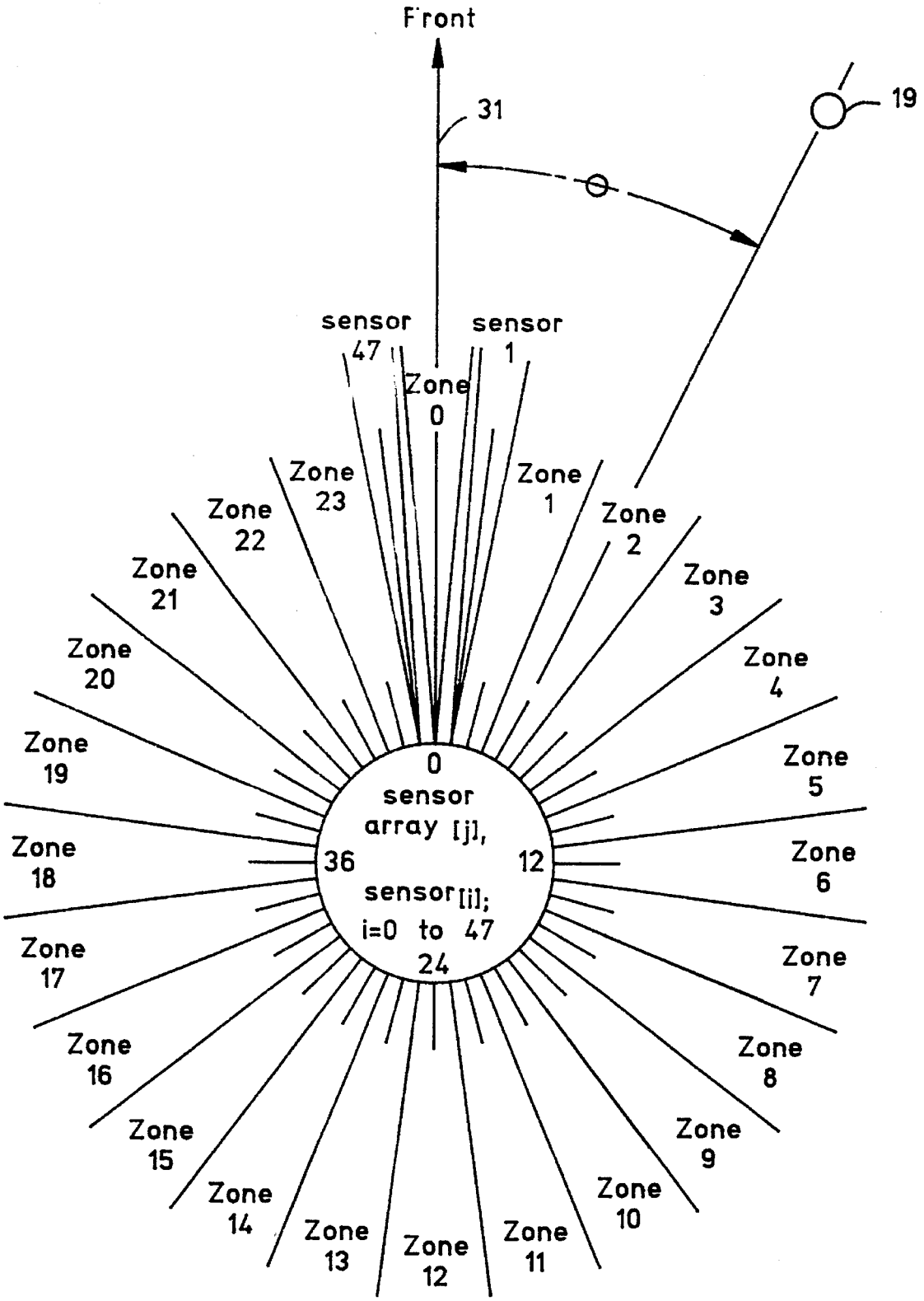
FIG. 16 demonstrates mapping an M number of fields of view of sensors configured into a circular sensor array to an N number of detection zones, where M and N are positive integers.

As an example, consider the case where individual sensors $14_{[1]}$ are arranged into a circular array $21_{[1]}$ such that the field of view of each sensor faces out from the center of the array $21_{[j]}$ to a detect a perturbation 19 which may be positioned, for example, as shown in FIG. 16, and having a bearing Θ with respect to the center axis 31 of the field of view of sensor $14_{[0]}$. The weight calculated for any given zone would be the sum of the weights of the individual sensors 14 located in that zone. If the field of view of a sensor 14 covers parts of two adjacent zones, then the weight assigned to that particular sensor would be divided between the two zones. The degree to which the sensor weight assigned to each zone is preferably proportional to the area of the sensor's field of view that overlaps each zone. In the example of FIG. 16, there are 48 sensors 14 arranged such that there is one sensor located in the center of each zone and one sensor located on the boundary of each zone. By way of example, in such case, the zone weights may be determined as follows:

$$\text{zone_weight}_{[0]} = \tfrac{1}{2}(\text{sensor_weight}_{[47]}) + (\text{sensor_weight}_{[0]}]) + \tfrac{1}{2}(\text{sensor_weight}_{[1]})$$

$$\text{zone_weight}_{[i]} = \tfrac{1}{2}(\text{sensor_weight}_{[2i-1]}]) + (\text{sensor_weight}_{[2i]}) + \tfrac{1}{2}(\text{sensor_weight}_{[2i+1]}),\ i = 1 \ldots 23$$

By mapping an arbitrary number of sensors to a prespecified number of zones for each sensor array as described above, the weights associated with a given zone may then be compared. These zone weights can then be further increased in the event that the sensors of different sensor arrays detect a perturbation in the same zone, thus resulting in an increase in the final composite perturbation score.

Figure 10:
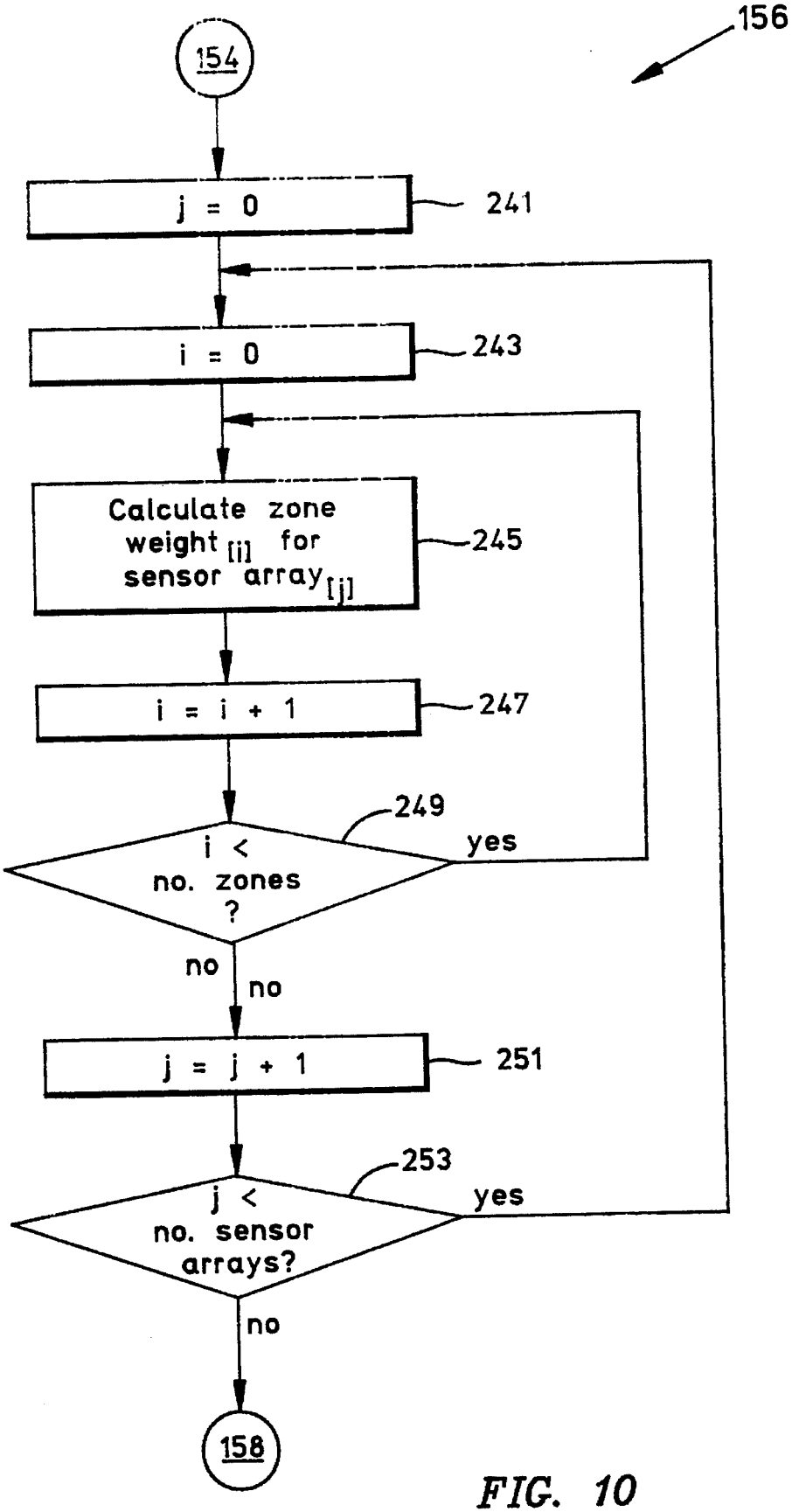
FIG. 10 is a flow chart showing the steps of block 156 of FIG. 4 in greater detail.

The calculation of the individual zone weights is described more specifically with reference to FIG. 10. At steps 241 and 243 indices j and i, respectively, are set to a value of 0. Index i represents a particular zone weight i. In FIG. 10, the index j represents a particular sensor array $12_j$. At step 245 the zone weight i is calculated for sensor $array_j$. Next, index i is incremented and a determination is made at step 249 as to whether i is less than the number of sensor zones. If the result of step 249 is yes, then the process returns to step 245, otherwise the process proceeds to step 251 where the index j is incremented. Continuing at step 253, a determination is made as to whether or not j is less than the number of sensor arrays. If the result of step 253 is yes, the program returns to step 243. If the result of step 253 is no, then the program continues at step 158 described above with reference to FIG. 4.

Figure 11:
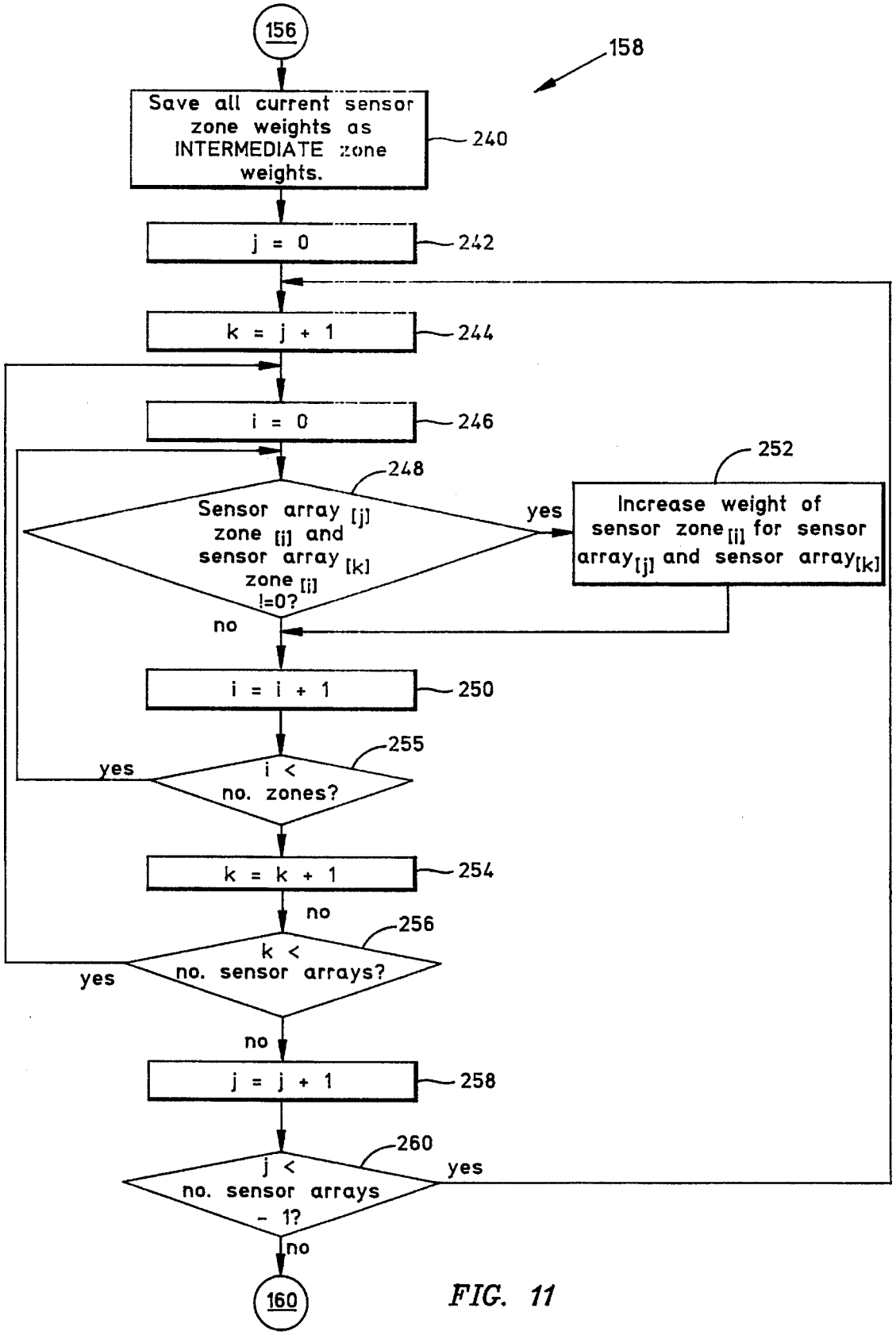
FIG. 11 is a flow chart showing the steps of block 158 of FIG. 4 in greater detail.

The process of increasing the weights of the sensor zones described with reference to step 158 of FIG. 4 is described more fully with reference to FIG. 11 where at step 240, all current sensor zone weights are saved as intermediate zone weights, as described above. Next, at step 242 index j is set to a value of 0. Proceeding with step 244 an index k is set equal to j+1. Index i then is set to a value of 0 at step 246. In FIG. 11, i represents a particular zone weight, j represents a specific sensor array $12_j$, and k represents another sensor array $12_k$. Then at step 248 a determination as to whether the sensors 14 of senor arrays $12_j$ and $12_k$ covering zone i have changed state at substantially the same time. If the result of step 248 is no, then the index i is incremented at step 250. If, however, the result of step 248 is yes, the program proceeds to step 252 where the weight of sensor zone i for sensor arrays $12_j$ and $12_k$ are increased. After step 250, the program proceeds to step 255 where the index i is compared to the number of sensor zones. If i is less than the number of sensor zones, the program returns to step 248. If, however, i is not less than the number of zones, the process continues to step 254 where k is incremented. Next, at step 256 a determination is made as to whether or not k is less than the number of sensor arrays $\mathbf{12}_j$. If the result of step 256 is yes, the program returns to step 246. If, however, the determination at step 256 is no, the program continues to step 258 where the index j is incremented. Next, at step 260, the value of j is compared to a value, N−1, where N represents the number of sensor arrays 12. If j<N−1, the program returns to step 244. If the result of step 260 is no, the program continues to step 160 described above with reference to FIG. 4.

Figure 12:
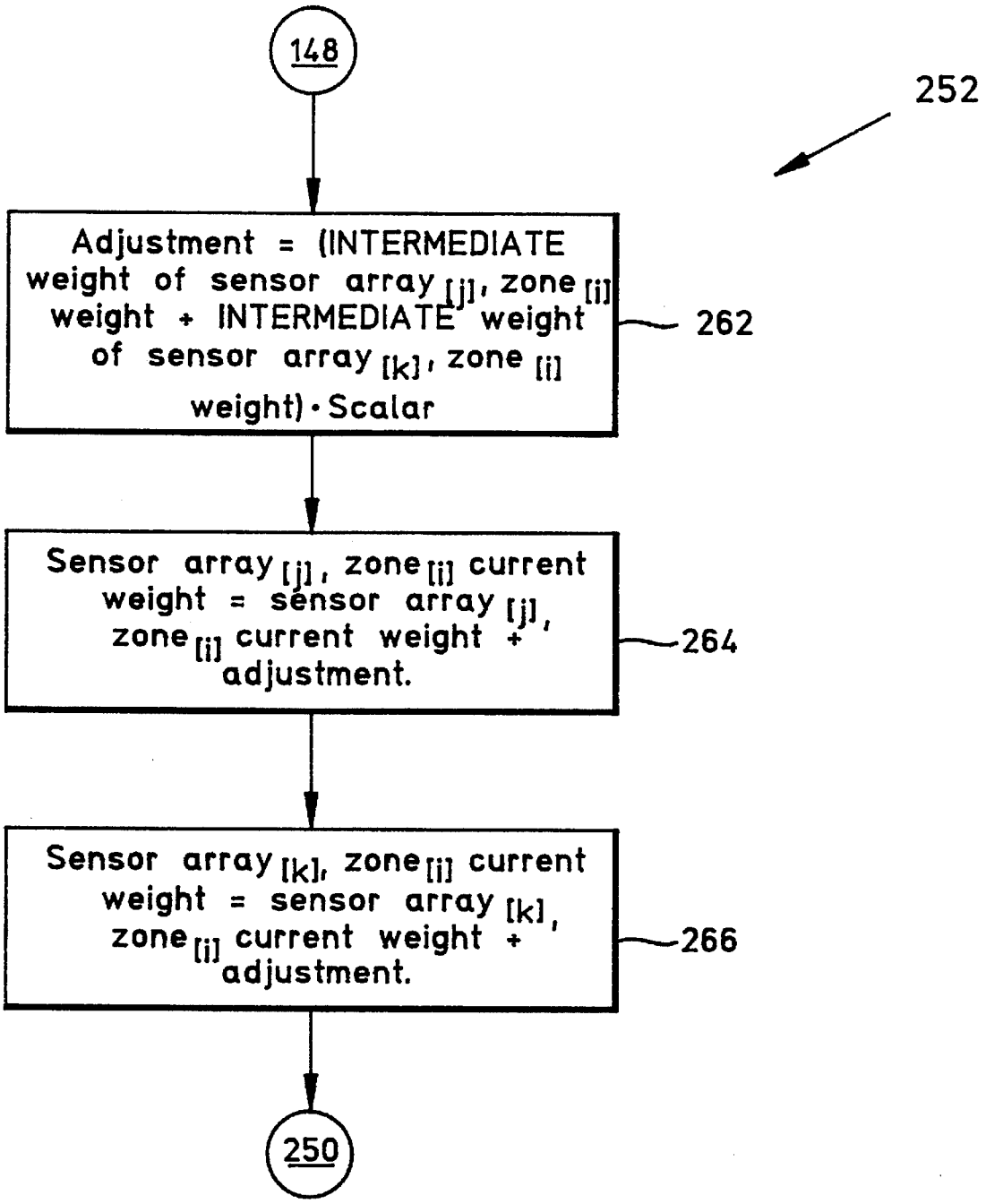
FIG. 12 is a flow chart showing the steps of block 252 of FIG. 11 in greater detail.

Further details regarding step 252 shown in FIG. 11 are described with reference to FIG. 12. Referring now to FIG. 12, at step 262 a variable referred to as "adjustment" is defined as being equal to a scalar factor multiplied by the quantity of the sum of the intermediate weight of zone i for sensor array $\mathbf{12}_j$, and the intermediate weight of zone i for sensor array $\mathbf{12}_k$. Next, at step 264, the current weight of sensor zone i for sensor array $\mathbf{12}_j$ is set equal to the weight o sensor zone i for sensor array $\mathbf{12}_j$ plus the adjustment variable. Then at step 266, the current weight of sensor zone i for sensor array $\mathbf{12}_k$ is set equal to the current weight of sensor zone i for sensor array $\mathbf{12}_k$ plus the adjustment variable.

Step 160 of FIG. 4 is described in greater detail with reference to FIG. 13 where at step 270 index counter i is set equal to zero, where i represents a particular detection zone, and a variable referred to as "current maximum zone weight" is set equal to zero. Next at step 272, the zone weight for zone i is set equal to the sum of the zone weights for each sensor array $\mathbf{12}_1$ through $\mathbf{12}_j$. That is:

$$\text{zone weight}_i = \text{zone weight}_i \text{ for sensor array } 12_1 + \text{zone weight}_i \text{ for sensor array } 12_2 + \ldots \text{zone weight}_i \text{ for sensor array } 12_j.$$

A comparison is then made at step 274 to determine whether zone weight$_i$ is greater than the current maximum weight. If the result of step 274 is no, the program continues to step 276 where the index i is incremented. If, however, the result of 274 is yes, then the current maximum weight is set equal to the zone weight$_i$ defined at step 278. At step 280 the index i is compared to the number of zones. If i is less than the number of zones, the process returns to step 272. If i is equal to or greater than the number of zones, then the program continues to step 282 where a variable referred to as "maximum weight" is set equal to the greatest maximum weight of the last M calculated current maximum weights, where M is a positive integer. Step 282 is referred to as a "smoothing algorithm."

The perturbation smoothing algorithm is employed to smooth out the composite perturbation scores to be output. This is done by storing the last M scores which have been calculated and their associated bearings in an array, where M is a positive integer. The output of the perturbation smoothing algorithm is the maximum of the M values and the bearing associated with the last M value above the threshold value. The value M may, by way of example, typically be 10 to 15, representing approximately 3–5 seconds of sensor data.

For example, if M=13 and the composites are stored in an array called "old_composites," then the current composite to be output ("curr_composite") could be calculated as follows:

$$\text{curr composite}=\text{maximum}(\text{old_composite}_{[i]}, (i=0 \text{ to } 12)$$

The bearing associated with curr_composite is the last known bearing of the perturbation. The last known bearing is defined as the bearing associated with the last time the composite perturbation score was above the alarm threshold. This bearing may or may not be the bearing associated with the maximum of the old composites. For example, consider the case, presented below for purposes of illustration only without intending to limit the scope of the invention, in which the old composites are as follows:

| | |
|---|---|
| old composite$_{[0]}$ = 0 | (most recent calculation) |
| old composite$_{[1]}$ = 12 | |
| old composite$_{[2]}$ = 12 | |
| old composite$_{[3]}$ = 20 | |
| old composite$_{[4]}$ = 40 | |
| old composite$_{[5]}$ = 55 | |
| old composite$_{[6]}$ = 55 | |
| old composite$_{[7]}$ = 78 | |
| old composite$_{[8]}$ = 80 | |
| old composite$_{[9]}$ = 70 | |
| old composite$_{[10]}$ = 65 | |
| old composite$_{[11]}$ = 50 | |
| old composite$_{[12]}$ = 47 | (least recent calculation) |

and the alarm threshold is 50, meaning that any composite perturbation score above 50 would be interpreted as an alarm, then the "current composite" to be output would be 80 and the bearing would be the bearing associated with old composite$_{[5]}$ since that was the last time the composite perturbation score was above the alarm threshold.

Continuing from step 282, the program proceeds to step 284 where a persistence factor ("PF") is calculated which is used to adjust the composite perturbation score by a predefined contribution. The PF is indicative of and proportional to the magnitude and duration of prior activity in the area under surveillance. The PF serves-to increase system sensitivity for scenarios where some activity was previously detected, though this activity was in itself insufficient to generate an alarm condition. The persistence factor is defined as follows:

$$PF=\int F(t)\, M(t)\, dt$$

where F(t) represents some time-dependent weighting function, and M(t) similarly represents to magnitude of the observed composite perturbation score as a function of time. This can be piecewise approximated over N arbitrary time increments as:

$$PF = \sum_{i=0}^{n} F_i \times M_i$$

$$= F_1 M_1 + F_2 M_2 + F_3 M_3 + \ldots + F_n M_n$$

F(t) can be represented as a linear function which varies from 0 at T(0) to 1 at T(f), with the time between T(0) and T(f) broken up into n sample periods. For example, if n=10, then T(1)=0.1, T(2)=0.2, T(3)=0.3, etc. up to T(10)=1.

M(t) meanwhile can be piecewise implemented as the maximum observed composite perturbation score over any given time increment or sample period. In keeping with the above example which assumed 10 sample periods, the equation would appear as follows:

$$PF=S[0.1M(\mathbf{1})+0.2M(\mathbf{2})+0.3M(\mathbf{3})+0.4M(\mathbf{4}). \ldots +M(\mathbf{10})]$$

where M(1) through M(10) are the maximum composite perturbation score values observed during sample periods 1 through 10, respectively, and S is a scalar.

The PF should have some maximum upward bound, as for example 10. Then at step 286, the persistence factor is added to the current composite perturbation score as follows:

Final Composite Perturbation Score=Initial Composite Perturbation Score+*PF*.

The process then returns to step 108 described above with reference to FIG. 2.

Figure 13:
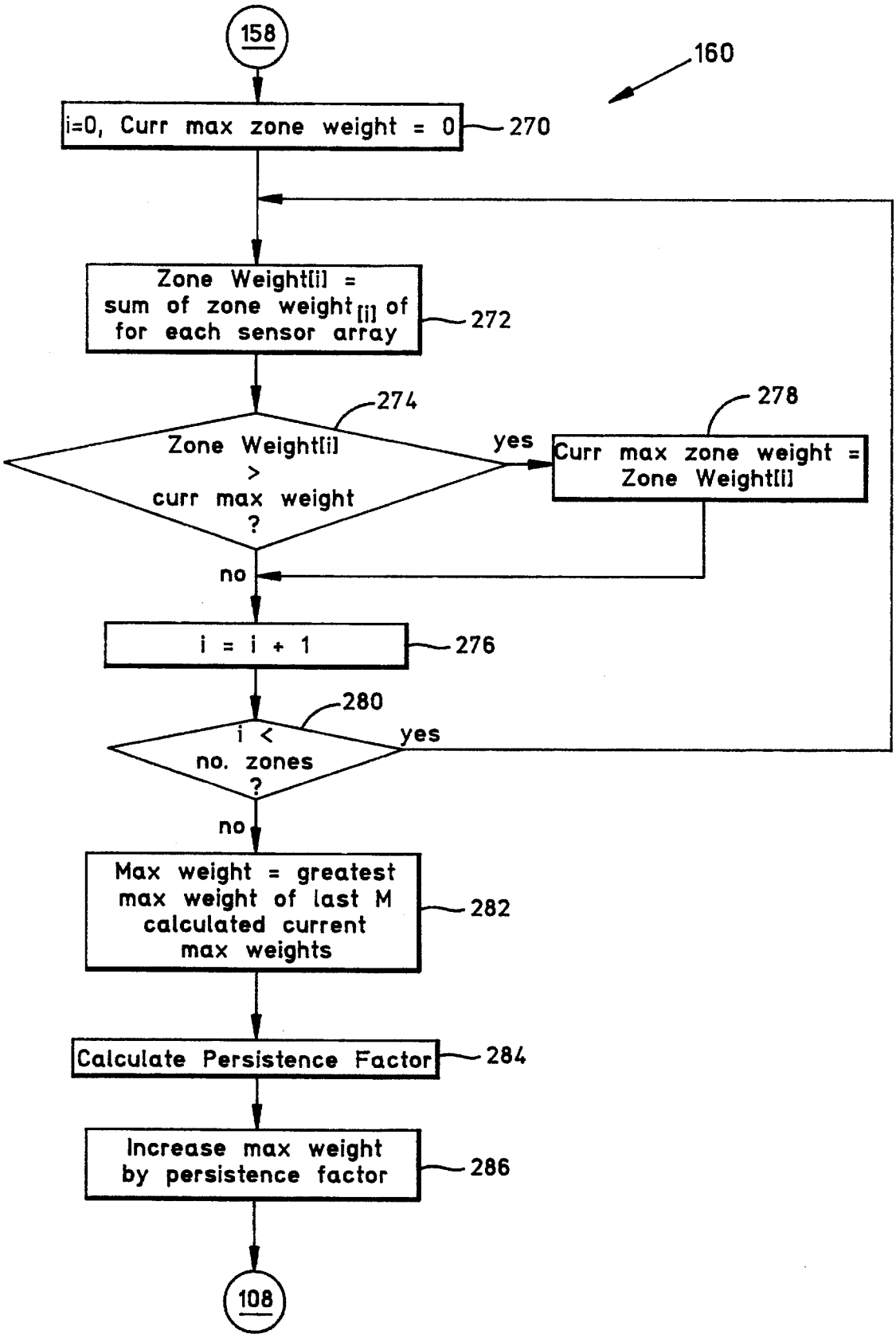
FIG. 13 is a flow chart showing the steps of block 160 of FIG. 4 in greater detail.
Figure 14:
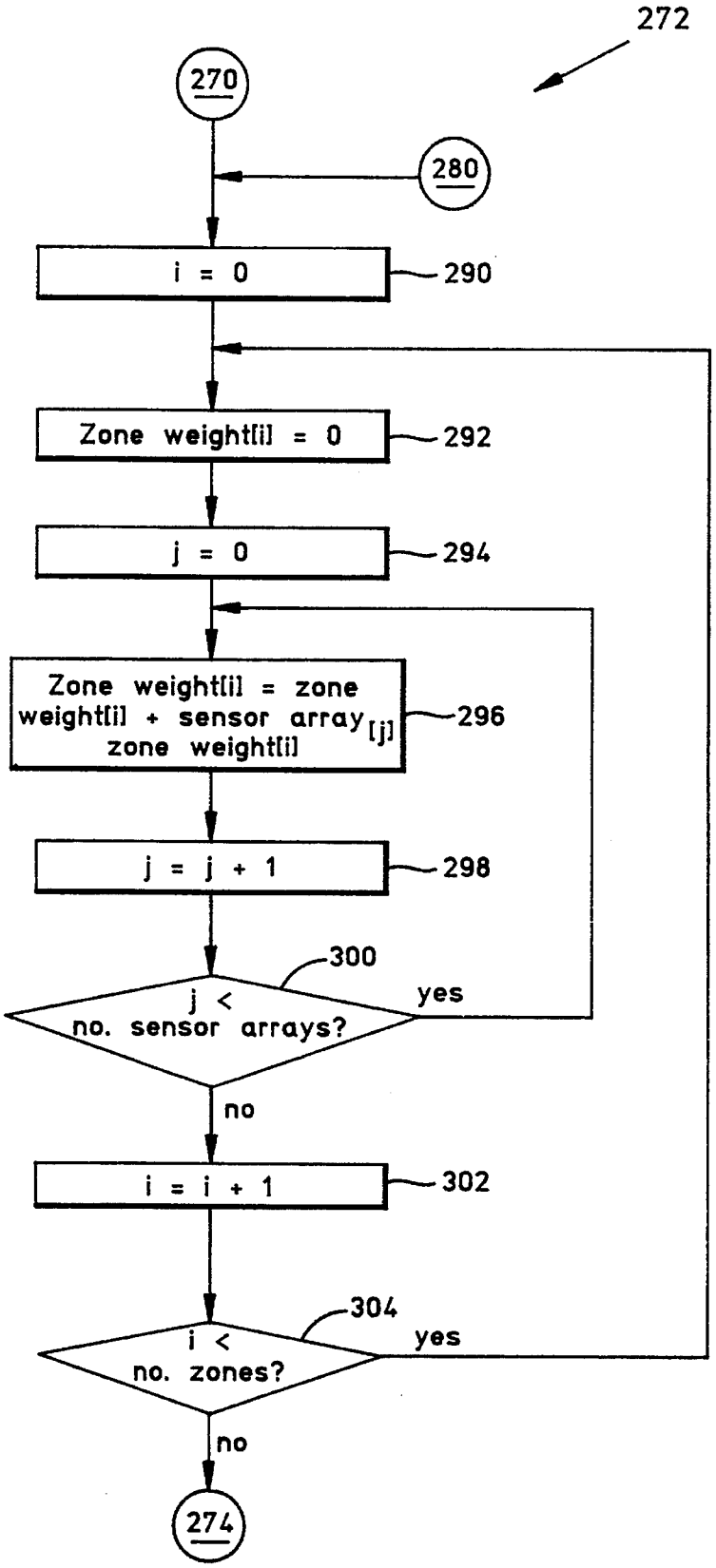
FIG. 14 is a flow chart showing the steps of block 272 of FIG. 13 in greater detail.

Step 272 of FIG. 13 is described in greater detail with reference to FIG. 14 where at step 290, the index i is set equal to zero, where in FIG. 14, i represents a particular zone weight$_i$. A variable "zone weight" is set equal to zero at step 292. Then the index j is set equal to zero at step 294, where j represents a particular sensor array 12$_j$. At step 296, zone weight$_i$ is redefined as the sum of zone weight$_i$ for sensor array 12$_j$ plus zone weight. Next, j is incremented at step 298. The process continues to step 300 where j is compared to the number j of sensor arrays 12. If the index value of j is less than the number of sensor arrays 12 (a result of "yes"), the program returns to step 296. If j is equal to or greater than the number of sensor arrays 12 (a result of "no"), then the index i is incremented at step 302. At step 304, index i is compared to the number of sensor zones. If the index value of i is less than the number of sensor zones (a result of "yes"), the program returns to step 292. If the result of step 304 is no, the program continues to step 274.

Obviously, many modifications and variations of the present invention are possible in the light of the above teachings. For example, the sensor arrays described above are comprised of sensors configured in a circular pattern so that their field of view is directed outwardly from a common center. However, it is to be understood that the sensor arrays may include multiple sensors arranged in an N×M matrix, where N and M are positive integers. Moreover, the scope of the invention includes providing the .output of the data processor to another processor or electronic security device such as an electronic lock. It is therefore to be understood that within the scope of the appended claims, the invention may be practiced otherwise than as specifically described.

What is claimed is:

1. A method for discerning perturbations within an environment, comprising the steps of:

1) initializing a sensor weight variable in a data processor;

2) initializing an iterand I in the data processor, where I is a positive integer;

3) initializing an iterand j in the data processor, where j is a positive integer;

4) monitoring an environment with a sensor array comprising an M number of $j^{th}$ sensors, each $j^{th}$ sensor monitoring a $j^{th}$ scene of the environment, where j and M are positive integers and j<M, said $j^{th}$ sensor generating $j^{th}$ output signals representing the $j^{th}$ scene;

5) employing the data processor to add a constant value to the sensor weight variable to provide a $j^{th}$ updated sensor weight variable if the $j^{th}$ output signals exhibit a change of state and if the $(j+1)^{th}$ output signals exhibit a change of state within a predetermined time period before occurrence of the first change of state, where $(j+1) \leqq M$;

6) storing the $j^{th}$ updated sensor weight variable;

7) incrementing the iterand j in the data processor;

8) repeating steps (4)–(7) an (M–2) number of times in the data processor;

9) determining the maximum of the (M–1) number of $j^{th}$ updated sensor weight variables;

10) storing the maximum $j^{th}$ sensor weight variable determined in step (9) as the $i^{th}$ initial composite threat score;

11) storing the product of the maximum $j^{th}$ sensor weight variable and an $i^{th}$ weighting factor to provide an $i^{th}$ product;

12) repeating steps (3)–(11) an (N–1) number of times, where N is a positive integer;

13) determining the sum of the N number of ith products to provide a persistence factor;

14) determining the sum of the persistence factor and the N number of ith initial composite threat scores; and 15) generating a human discernable output if the sum determined in step (14) is greater than a reference value.

2. The method of claim 1 further comprising the step of determining in said data processor a bearing to a perturbation detected within said environment from said $j^{th}$ and $(j+1)^{th}$ output signals.

* * * * *